US010538385B2

(12) United States Patent
Boyea

(10) Patent No.: US 10,538,385 B2
(45) **Date of Patent: *Jan. 21, 2020**

(54) EXTENDER FOR RECEPTACLE AND METHOD THEREOF

(71) Applicant: Christopher E. Boyea, Burnt Hills, NY (US)

(72) Inventor: Christopher E. Boyea, Burnt Hills, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/672,503

(22) Filed: Aug. 9, 2017

(65) Prior Publication Data

US 2017/0341859 A1 Nov. 30, 2017

Related U.S. Application Data

(63) Continuation of application No. 14/818,175, filed on Aug. 4, 2015.

(Continued)

(51) Int. Cl.
*B65D 25/02* (2006.01)
*B65D 5/355* (2006.01)

(Continued)

(52) U.S. Cl.
CPC ..... *B65F 1/10* (2013.01); *B65F 1/04* (2013.01); *B65F 1/1473* (2013.01)

(58) Field of Classification Search
CPC ..... B65F 1/04; B65F 1/08; B65F 1/10; B65F 1/1473; B65D 21/083

(Continued)

(56) References Cited

U.S. PATENT DOCUMENTS 1,238,090 A 8/1911 Beringer
1,666,294 A 4/1928 Downes-Martin (Continued)

FOREIGN PATENT DOCUMENTS

JP 2012140217 7/2012
JP 2012140217 A 7/2012

(Continued)

OTHER PUBLICATIONS

Office Action for U.S. Appl. No. 14/818,175, filed Aug. 4, 2014, dated Jan. 12, 2016.

(Continued)

*Primary Examiner* — J. Gregory Pickett
*Assistant Examiner* — Niki M Eloshway
(74) *Attorney, Agent, or Firm* — Schmeiser, Olsen & Watts, LLP

(57) ABSTRACT

An extender for a receptacle to increase a storage capacity of a typical garbage receptacle is provided. The extender may be inserted into a receptacle, or may be placed on the receptacle. A method for collecting garbage is also provided, including providing a receptacle for storing waste materials, the receptacle configured to be lifted and inverted by a mechanical means of a garbage collection vehicle to empty the waste materials, providing an extender for use with the receptacle, the extender cooperating with the receptacle to increase a storage capacity of the provided receptacle, wherein the extender is disposable along with the waste materials, and at the same time, collecting the waste materials and the extender using the mechanical means of the garbage collection means.

14 Claims, 18 Drawing Sheets

Related U.S. Application Data

(60) Provisional application No. 62/032,875, filed on Aug. 4, 2014.

(51) Int. Cl.

| | |
|---|---|
| ***B65F 1/10*** | (2006.01) |
| ***B65F 1/04*** | (2006.01) |
| *B65D 25/38* | (2006.01) |
| *B65F 1/14* | (2006.01) |

(58) Field of Classification Search
USPC ..... 220/720, 4.03, 4.26, 495.11, 908.3
See application file for complete search history.

(56) References Cited

U.S. PATENT DOCUMENTS

| | | | |
|---|---|---|---|
| 1,724,743 | A | 8/1929 | Allen |
| 1,858,793 | A | 5/1932 | Archibald |
| 2,107,995 | A | 2/1938 | Statham |
| 2,429,958 | A | 10/1947 | Liebmann |
| 2,572,610 | A | 10/1951 | Gilbert |
| 2,927,377 | A | 3/1960 | Lewis |
| 3,119,494 | A | 1/1964 | Rosenstiel |
| 3,525,962 | A | 8/1970 | Javorik |
| 3,539,091 | A | 11/1970 | Murray |
| 4,161,252 | A | 7/1979 | Howells |
| 4,280,676 | A | 7/1981 | Betts |
| 4,628,007 | A | 12/1986 | Ledsham |
| 4,852,757 | A | 8/1989 | Gold |
| 4,860,910 | A | 8/1989 | Zipper |
| 4,940,138 | A | 7/1990 | Hornstein |
| 4,974,737 | A | 12/1990 | Miller |
| 4,976,737 | A | 12/1990 | Leake |
| 4,979,547 | A | 12/1990 | Hoerner |
| 5,035,563 | A | 1/1991 | Mezey |
| 5,022,548 | A | 6/1991 | Stakis |
| D318,163 | S | 7/1991 | Chalmers |
| D318,896 | S | 8/1991 | Starkweather |
| 5,048,778 | A | 9/1991 | Wright |
| 5,271,589 | A | 12/1993 | Belous |
| 5,417,338 | A | 5/1995 | Roy et al. |
| 5,445,397 | A | 8/1995 | Evans |
| 5,598,942 | A | 2/1997 | Cowie |
| 5,642,828 | A | 7/1997 | Sorens |
| 5,765,614 | A | 6/1998 | Kardosh et al. |
| 5,897,084 | A | 4/1999 | Judge |
| 5,915,768 | A | 6/1999 | Young |
| 6,062,415 | A | 5/2000 | Harper |
| 6,131,759 | A | 10/2000 | Young |
| 6,135,518 | A | 10/2000 | Holthaus |
| 6,581,796 | B1 * | 6/2003 | Pilkinton ..... B65F 1/06 220/495.04 |
| 6,938,860 | B2 | 9/2005 | Singleton |
| 7,077,283 | B2 | 7/2006 | Yang et al. |
| 7,192,037 | B1 | 3/2007 | Peña |
| 7,219,705 | B2 | 5/2007 | Wallek |
| 7,302,978 | B1 | 12/2007 | Kolarik |
| 7,562,784 | B2 | 7/2009 | Stevenson |
| 7,789,238 | B2 | 9/2010 | Claypool |
| 7,866,538 | B2 | 1/2011 | Liao |
| D633,268 | S | 2/2011 | Bottita |
| 7,886,926 | B2 | 2/2011 | Orgeldinger |
| 7,984,733 | B2 | 7/2011 | Noonan |
| 8,479,780 | B2 | 7/2013 | Fernandez et al. |
| 8,757,563 | B2 | 6/2014 | Muse |
| 9,771,184 | B2 | 9/2017 | Arcot |
| 9,783,362 | B2 | 10/2017 | Boyea |
| 2004/0089657 | A1 | 5/2004 | Waszak |
| 2006/0144467 | A1 | 7/2006 | Butzer |
| 2007/0158345 | A1 | 7/2007 | Booth et al. |
| 2008/0029658 | A1 | 2/2008 | Vanbost |
| 2008/0251526 | A1 | 10/2008 | Fick |
| 2010/0089916 | A1 | 4/2010 | Fielden |
| 2010/0108826 | A1 | 5/2010 | Fernandez |
| 2011/0309209 | A1 | 12/2011 | Muse |
| 2012/0012228 | A1 | 1/2012 | Karabas |
| 2012/0248118 | A1 | 10/2012 | Perkowski |
| 2015/0014310 | A1 | 1/2015 | Liu et al. |
| 2015/0069054 | A1 | 3/2015 | Nolan et al. |
| 2015/0375558 | A1 | 12/2015 | Ben-Or |
| 2016/0031641 | A1 | 2/2016 | Boyea |
| 2016/0145041 | A1 | 5/2016 | Fritch |
| 2017/0210558 | A1 | 7/2017 | Boyea |
| 2017/0341859 | A1 | 11/2017 | Boyea |
| 2018/0086492 | A1 | 3/2018 | Weathers |
| 2018/0093826 | A1 | 4/2018 | Boyea |

FOREIGN PATENT DOCUMENTS

| | | | |
|---|---|---|---|
| KR | 2020110006981 | U | 2/2013 |
| WO | 2013150307 | A1 | 10/2013 |

OTHER PUBLICATIONS

Final Office Action for U.S. Appl. No. 14/818,175, filed Aug. 4. 2014, dated Sep. 14, 2016.
Advisory Action for U.S. Appl. No. 14/818,175, filed Aug. 4, 2014, dated Jan. 10, 2017.
Office Action for U.S. Appl. No. 14/818,175, filed Aug. 4, 2014, dated Mar. 13, 2017.
Notice of Allowance for U.S. Appl. No. 14/818,175, filed Aug. 4, 2014, dated Jun. 16, 2017.
Office Action for U.S. Appl. No. 15/480,723, filed Apr. 6, 2017, dated Jun. 6, 2017.
Issue Notification (dated Sep. 20, 2017) for U.S. Appl. No. 14/818,175, filed Aug. 5, 2015.
Office Action (dated Jun. 6, 2017) for U.S. Appl. No. 15/480,723, filed Apr. 6, 2017.
Office Action (dated Jan. 26, 2018) for U.S. Appl. No. 15/831,600, filed Dec. 5, 2017.
Office Action (dated Sep. 7, 2018) for U.S. Appl. No. 15/831,600, filed Dec. 5, 2017.
Office Action (dated Dec. 13, 2018) for U.S. Appl. No. 15/831,600, filed Dec. 5, 2017.
Office Action (dated Mar. 7, 2019) for U.S. Appl. No. 15/982,807, filed May 17, 2018.
Office Action (dated Sep. 28, 2018) for U.S. Appl. No. 15/982,807, filed May 17, 2018.

* cited by examiner providing a receptacle for storing waste materials, the receptacle configured to be lifted and inverted by a mechanical means of a garbage collection vehicle to empty the waste materials providing an extender for use with the receptacle, the extender cooperating with the receptacle to increase a storage capacity of the provided receptacle, wherein the extender is disposable along with the waste materials at the same time, collecting the waste materials and the extender using the mechanical means of the garbage collection means

FIG. 20

EXTENDER FOR RECEPTACLE AND METHOD THEREOF

CROSS-REFERENCE TO RELATED APPLICATIONS

This application is a continuation application that claims priority to and the benefit of U.S. application Ser. No. 14/818,175, filed Aug. 4, 2015, and entitled "Extender For a Receptacle and Method Thereof," which claims priority to Provisional Application No. 62/032,875, having a filing date of Aug. 4, 2014, the entire contents of which are hereby incorporated by reference.

FIELD OF TECHNOLOGY

The following relates to waste management disposal and containment, and more specifically to embodiments of a device that can increase the capacity of a standard receptacle, while also making garbage collection more efficient.

BACKGROUND

Receptacles, such as garbage cans, typically come in standard sizes. In some households, the standard capacity of the garbage is exceeded before the garbage pickup is scheduled to come. This is especially true when a household hosts a party or an event that results in a larger than normal amount of garbage. The current solution is to stack the garbage next to the garbage can, or purchase an additional garbage can. Stacking the garbage next to the garbage perpetuates an odorous environment, is aesthetically unappealing, and adds labor time for the garbage collectors. Purchasing an additional garbage takes up extra space, can lead to additional charges from a garbage collection company, and may not be compatible with automated garbage trucks.

Thus, a need exists for an apparatus and method for increasing a capacity of a receptacle, storing an additional amount of garbage, and a method of disposal.

SUMMARY

A first aspect relates generally to an extender for a receptacle, comprising: a plurality of walls, each of the plurality of walls being tapered from a first end of the extender to a second end of the extender, the plurality of walls being joined together to define an interior space for receiving waste materials, and at least one vertical slit located on one or more of the plurality of walls, the at least vertical slit permitting a deflection of a section of the one or more of the plurality walls, wherein the extender increases a storage capacity of the receptacle when the extender is inserted into an interior of the receptacle, the further the extender being inserted into the receptacle the stronger the friction fit between the receptacle and the extender due to the plurality of tapered walls.

A second aspect relates generally to an extender for increasing a storage capacity of a receptacle, comprising: a plurality of walls, the plurality of walls including a front wall, a back wall, a first side wall, and a second side wall, the plurality of walls being joined together to define an interior space for receiving waste materials, and at least one wing located on the first side wall of the plurality of walls, the at least one wing protruding a distance beyond a bottom edge of the first side wall, wherein, when the extender is placed atop the receptacle and external to an interior of the receptacle, the one or more wing is disposed within the interior of the receptacle.

A third aspect relates generally to a method for collecting garbage, comprising: providing a receptacle for storing waste materials, the receptacle configured to be lifted and inverted by a mechanical means of a garbage collection vehicle to empty the waste materials, providing an extender for use with the receptacle, the extender cooperating with the receptacle to increase a storage capacity of the provided receptacle, wherein the extender is disposable along with the waste materials, and at the same time, collecting the waste materials and the extender using the mechanical means of the garbage collection means.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein:

FIG. 20 depicts a flowchart of an embodiment of a method.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
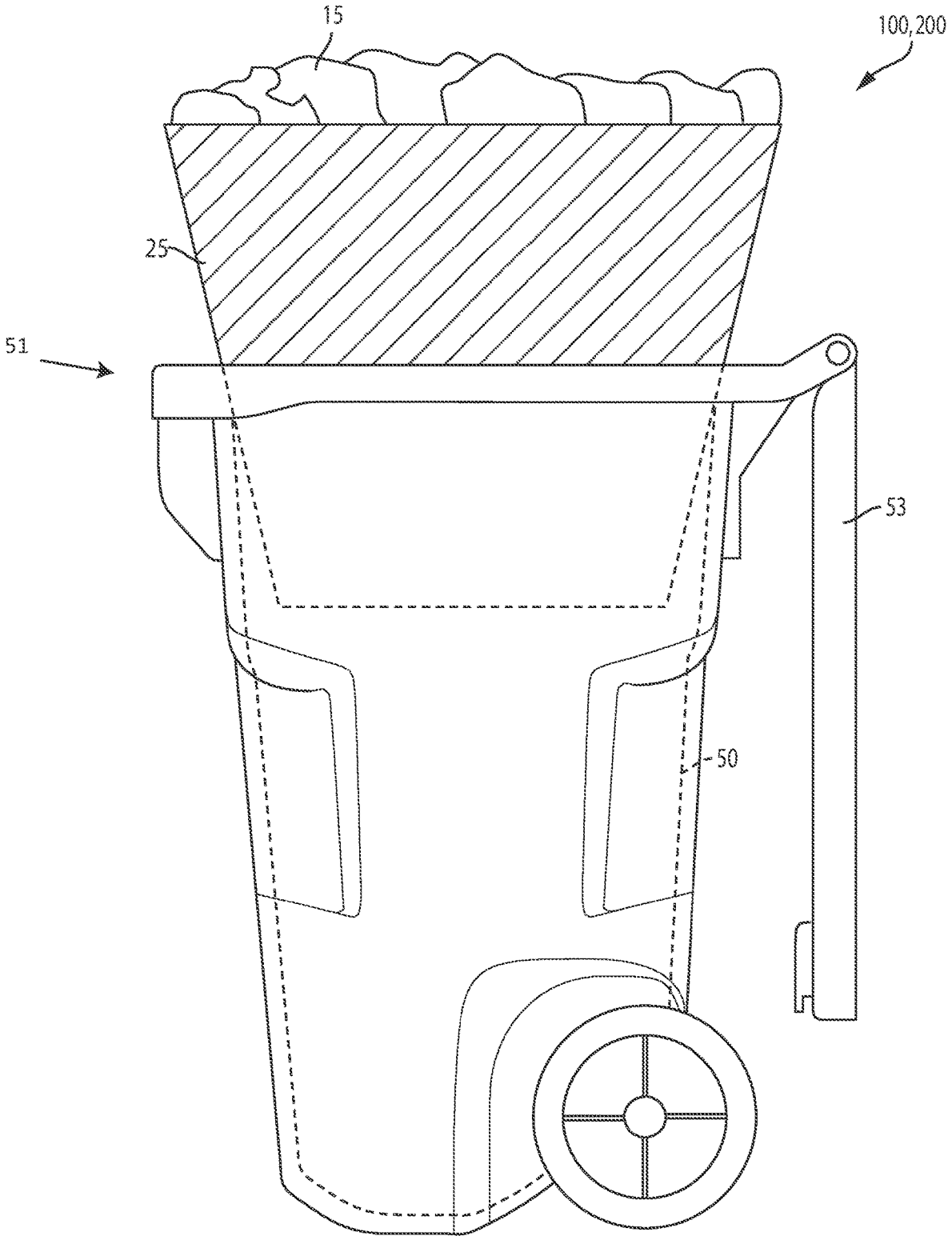
FIG. 1 depicts a schematic view of a first embodiment of an extender located within an embodiment of a receptacle.

Referring to the drawings, FIG. 1 depicts an embodiment of an extender 100, 200 operably engaged with a receptacle 50. The extender 100, 200 may be a device that may be configured to be placed at least partially within a receptacle 50, such as industry standard sized garbage can, to extend or otherwise increase a capacity of the receptacle 50. The increased capacity, labeled as increased capacity 25 in FIG. 1, is an amount of volume for storing garbage, waste, yard waste, leaves, etc., or any contents suitable for placement in a receptacle that is in addition to a maximum volume afforded by the receptacle 50. For example, if the receptacle 50 becomes full of waste materials 15, such as garbage, waste, recyclables, yard waste, and the like, any additional waste materials will not fit properly within the receptacle 50, and likely fall to the side of the receptacle 50, or can blow away due to the wind or other environmental elements. To increase a volume or storage capacity of the receptacle 50, embodiments of an extender 100, 200 may be placed at least partially within the receptacle 50 so that additional waste materials 15 may be added to the waste material already within the receptacle 50. While the extender 100, 200 is operatively attached to the receptacle 50, a storage capacity of the receptacle 50 is effectively increased because of the walls of the extender 100 extending beyond a top end 51 of the receptacle 50. Embodiments of the receptacle 50 may be a garbage can, a pail, a garbage pail, a transportable waste container, a waste collection device, a barrel, a bucket, and the like. Embodiments of the receptacle 50 may be an industrial garbage can, and may be compatible with automatic garbage truck loaders, for example, receptacles provided by waste collection companies for scheduled pickup. In some embodiments, the receptacle 50 may include a cover 53 that can be hingedly or otherwise pivotally attached to the receptacle 50. Further, embodiments of receptacle 50 may be various sizes, as might be offered/provided by a waste collection company or a municipality, or otherwise available for purchase at a home improvement store.

Figure 2:
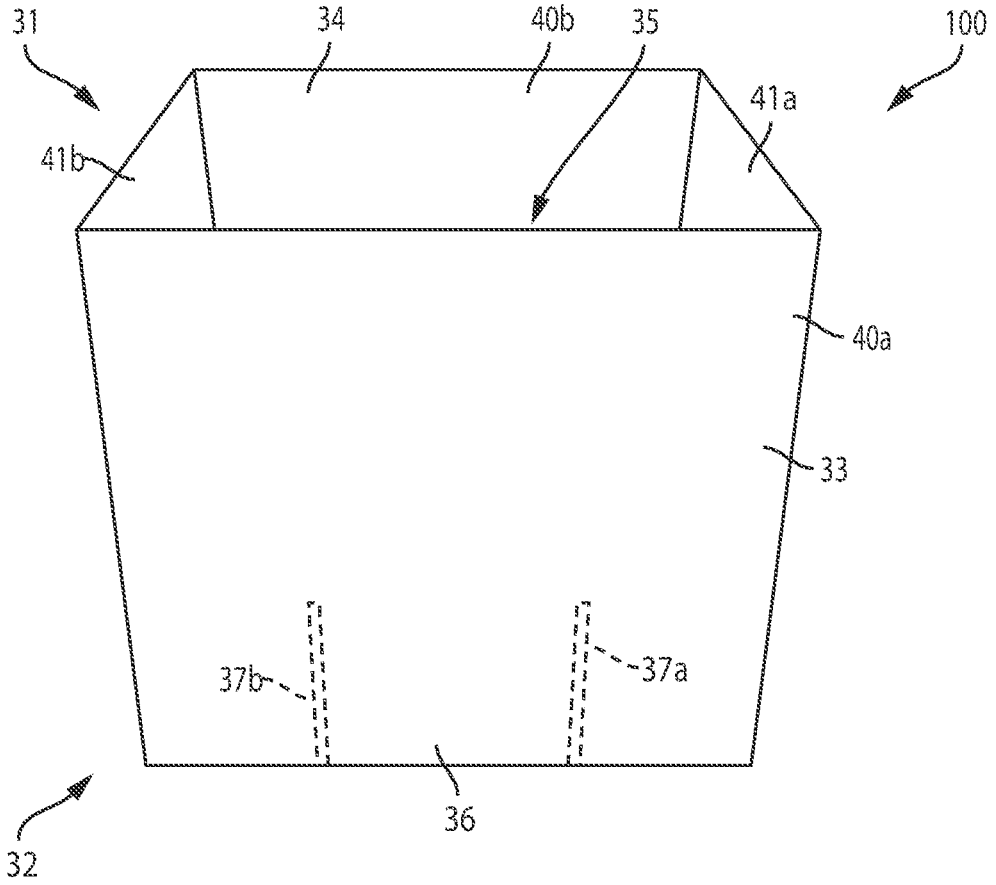
FIG. 2 depicts a perspective view of the first embodiment of an extender.

With continued reference to FIG. 1, an embodiment of extender 100 is depicted in FIG. 2. Embodiments of extender 100 may be an insert, a tapered box, a tapered structure, a garbage containment unit, a cardboard insert, or the like, sized and dimensioned to be placed within a receptacle 50 of various sizes. Embodiments of extender 100 may include a first end 31, a second end 32, an outer surface 33, an inner surface 34, and a general opening extending therethrough. Embodiments of extender 100 may be cone-shaped, and may be comprised of a single wall. Embodiments of the extender 100 may be tapered. For instance, embodiments of the extender 100 may taper in a direction from the first end 31 toward a second end 32, such that a width of the extender 100 may gradually decrease from the first end 31 to the second end 32. A tapered structure or configuration of the extender 100 may ensure or promote a friction fit with the receptacle 50 as the extender 100 is lowered or otherwise placed within an interior of the receptacle 50. The tapered configuration may also accommodate various sizes of an interior of various receptacles 50. Further embodiments of the extender 100 may include a tapered section proximate or otherwise near the second end 32, wherein a portion of the extender 100 (e.g. proximate or otherwise near the first end 31) is not tapered, and only begins to taper at a point proximate or otherwise near the second end 32.

Moreover, embodiments of the extender 100 may include a plurality of walls 40*a*, 40*b*, 41*a*, 41*b*. The plurality of walls 40*a*, 40*b*, 41*a*, 41*b* may form or otherwise define an interior space 35 of the extender 100. Each of the plurality of walls 40*a*, 40*b*, 41*a*, 41*b* may be shaped like a trapezoid to facilitate the tapered shape/configuration of the extender 100. A number and an arrangement of the plurality of walls, when operably configured, may correspond to a geometric shape of an opening of the receptacle 50 so that it may at least partially fit within the receptacle 50. In one embodiment, the extender 100 may include four walls, with a front wall 40*a*, a back wall 40*b*, a first side wall 41*a*, and a second side wall 41*b*. The walls 40*a*, 40*b*, 41*a*, 41*b* may be equal in size, or may vary in size with respect to each other. Furthermore, the walls 40*a*, 40*b*, 41*a*, 41*b* may be structurally integral with each other and joined along each edge to the next wall, as shown in FIG. 2. The edges may be creased or pre-creased to facilitate or promote flexibility of the extender 100. The flexibility of the extender 100 may vary, but in some cases, the extender 100 may be able to be folded into a flat unit, while all of the edges of the walls 40*a*, 40*b*, 41, 41*b* remain connected, structurally integral or otherwise.

Figure 3:
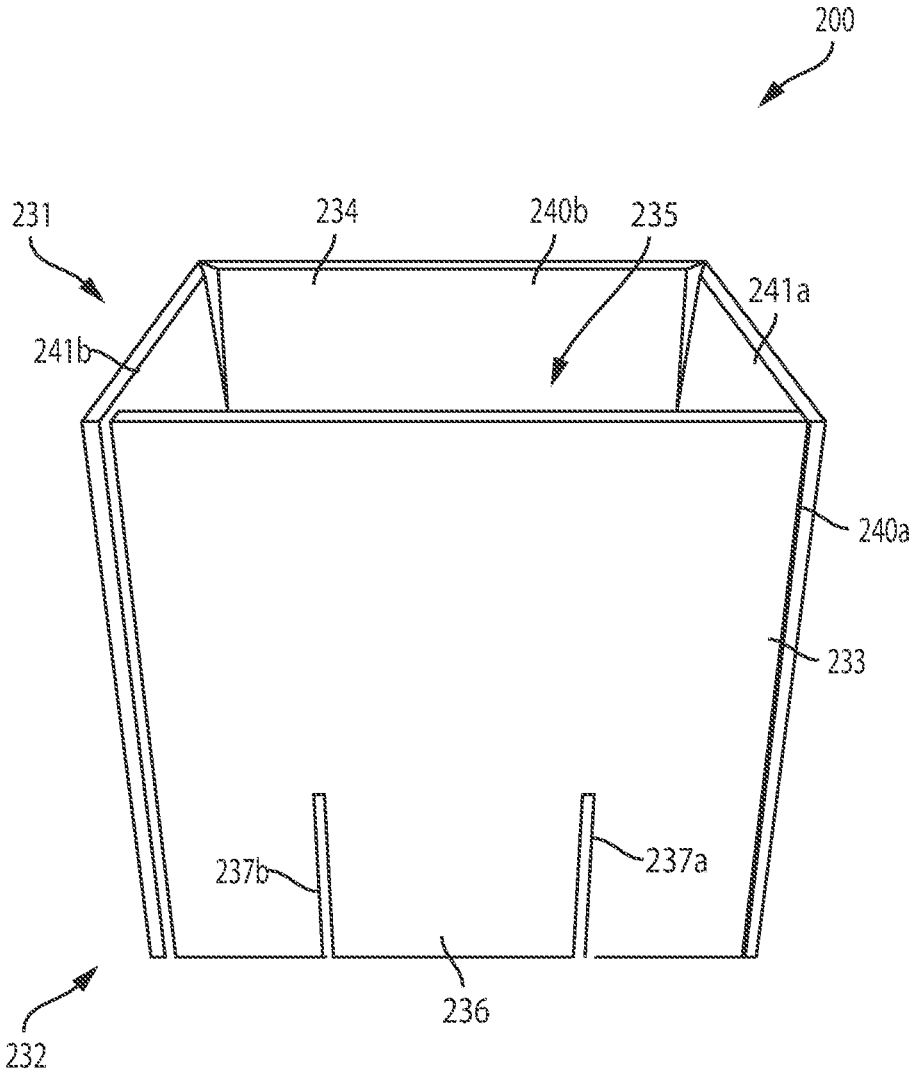
FIG. 3 depicts a perspective view of a second embodiment of an extender.
Figure 4:
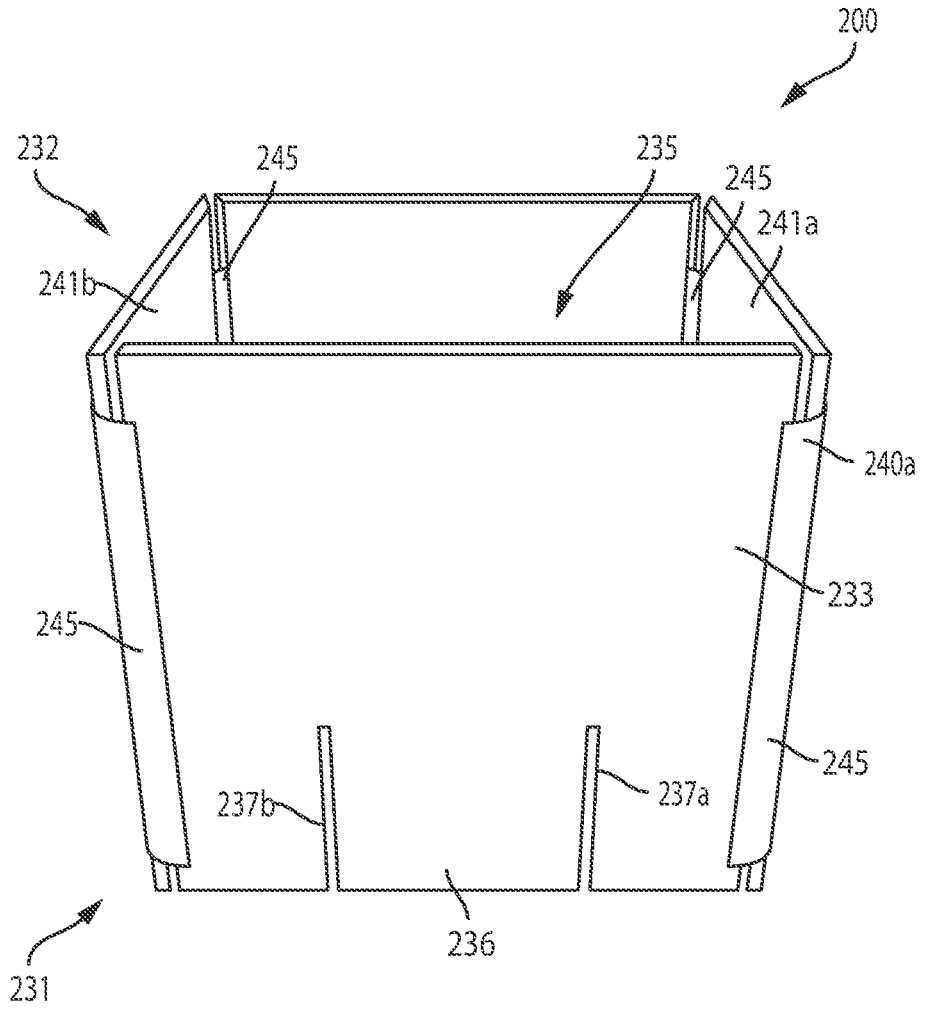
FIG. 4 depicts a perspective view of the second embodiment of an extender with an embodiment of a connection element.

FIG. 3 depicts an embodiment of extender 200. Embodiments of extender 200 may share the same or substantially the same structural and functional aspects of extender 100, including a first end 231, a second end 232, an outer surface 233, and inner surface 234, a general opening therethrough, and an interior space 235. However, extender 200 may include at least one edge of one of the plurality of walls 240*a*, 240*b*, 241*a*, 241*b* may be a free edge, which may also allow the extender 200 to be packaged and sold as a flat, or relatively flat, or a folded flat unit. For example, a left edge of front wall 240*a* may be a free edge, while the other, right, edge of the front wall 240*a* is connected to the left edge of first side wall 241*a*. In this example, an edge of the second side wall 41*b* may also be a free edge. Any configuration or combination of free edges may be implemented to form extender 200. In some operable configurations, such as shown in FIG. 4, the free edges may be connected to each other for added stability once ready for use. For instance, the free edges may be connected to each other using a connection element 245. Embodiments of connection element 245 may be an adhesive tape, such as duct tape, staples, glue, clap, or other suitable material or component that may join two edges of the walls 240*a*, 240*b*, 241*a*, 241*b* together. In other operable configurations, the free edges may remain unconnected when placed within the receptacle 50, wherein the free edges are proximate or otherwise near each other when in this operable configuration.

With continued reference to FIGS. 2-4, embodiments of extender 100, 200 may also include a deflection flap 36, 236. Embodiments of deflection flap 36, 236 may be a section of the extender 100, 200 of one or more walls of extender 100, 200 that may deflect inward or outward to accommodate various sizes of receptacle 50. The deflection, inward or outward, may further promote or otherwise ensure a friction fit between an inner surface of the receptacle 50 and the extender 100, 200. For example, receptacle 50 may have various interior shapes (e.g. protrusions, etc.) that may engage portions of the extender 100, 200 with a different force than another area of the extender 100, 200. The deflection flap or deflection portion 36, 236 may deflect or otherwise move inwardly or outwardly to increase a mechanical interference or friction fit between the receptacle 50 and the extender 100, 200 to compensate for looser connections between the receptacle 50 and the extender 100, 200 in other areas. The deflection of the flap 36, 236 may also be affected by waste materials already within receptacle 50, which may also promote friction fit between the extender 100, 200 and the receptacle 50. Embodiments of the deflection flap 36, 236 may be formed by one or more vertical slits 237*a*, 237*b* extending from a second end 32, 232 of the extender 100, 200 a distance towards the first end 32, 232. The vertical slits may permit deflection inwardly or outwardly, as described above. The vertical slits 237*a*, 237*b* may be perforations, or may be a continuous cut into the extender 100, 200. Furthermore, embodiments of the extender 100, 200 may be made out of cardboard or other suitable material. The material(s) forming the extender 100, 200 may be disposable. However, in some embodiments, the extender 100, 200 may be made of a material that can be reused without significant risk of damage if exposed to environmental elements. In further embodiments, the extender 100, 200 may be made out a metal, such as aluminum, or plastic and can be recycled with the other contents within the receptacle 50, such as known recyclable items that are commonly discarded.

Figure 5:
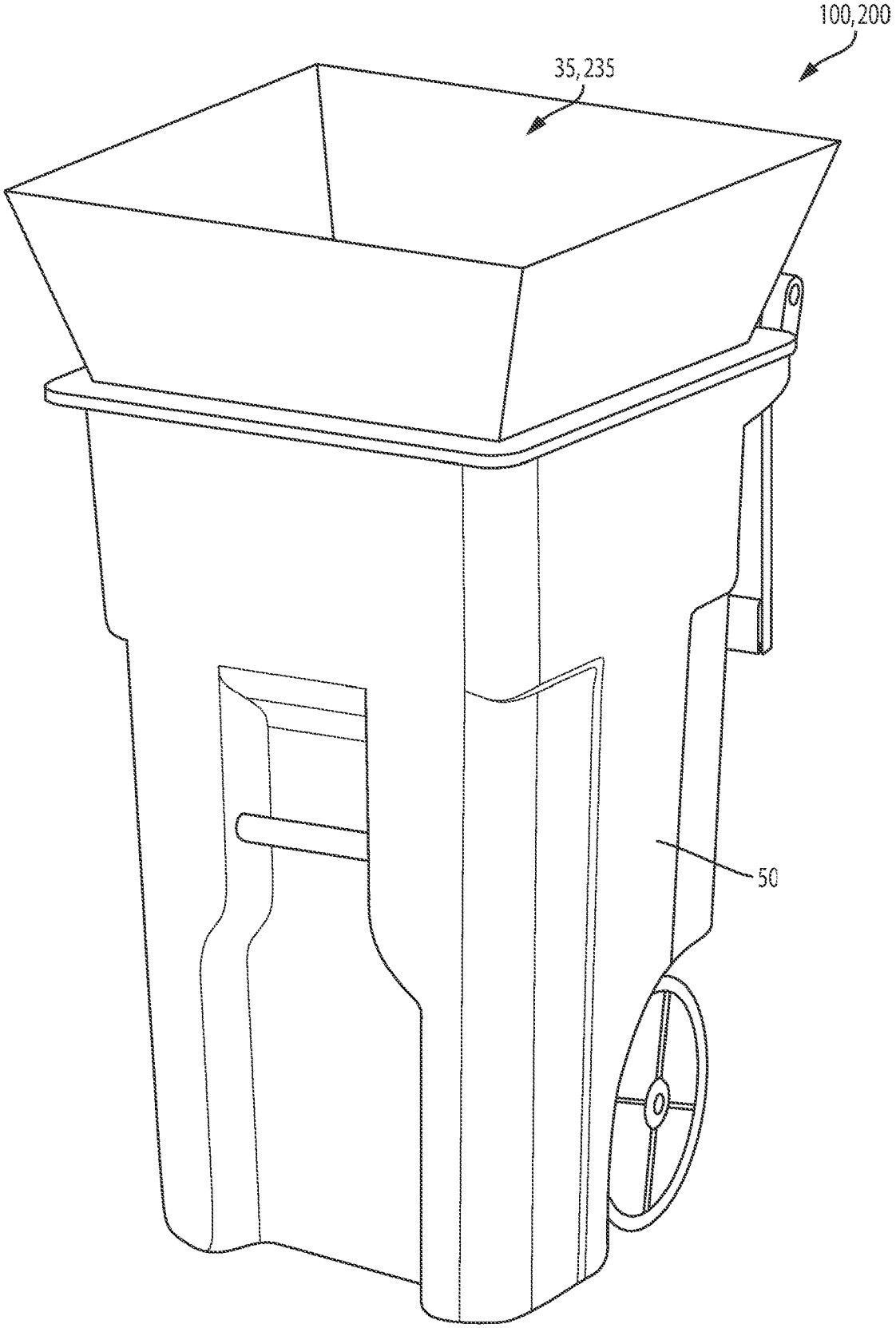
FIG. 5 depicts a perspective view of an embodiment of an extender operably configured with an embodiment of a receptacle.
Figure 6:
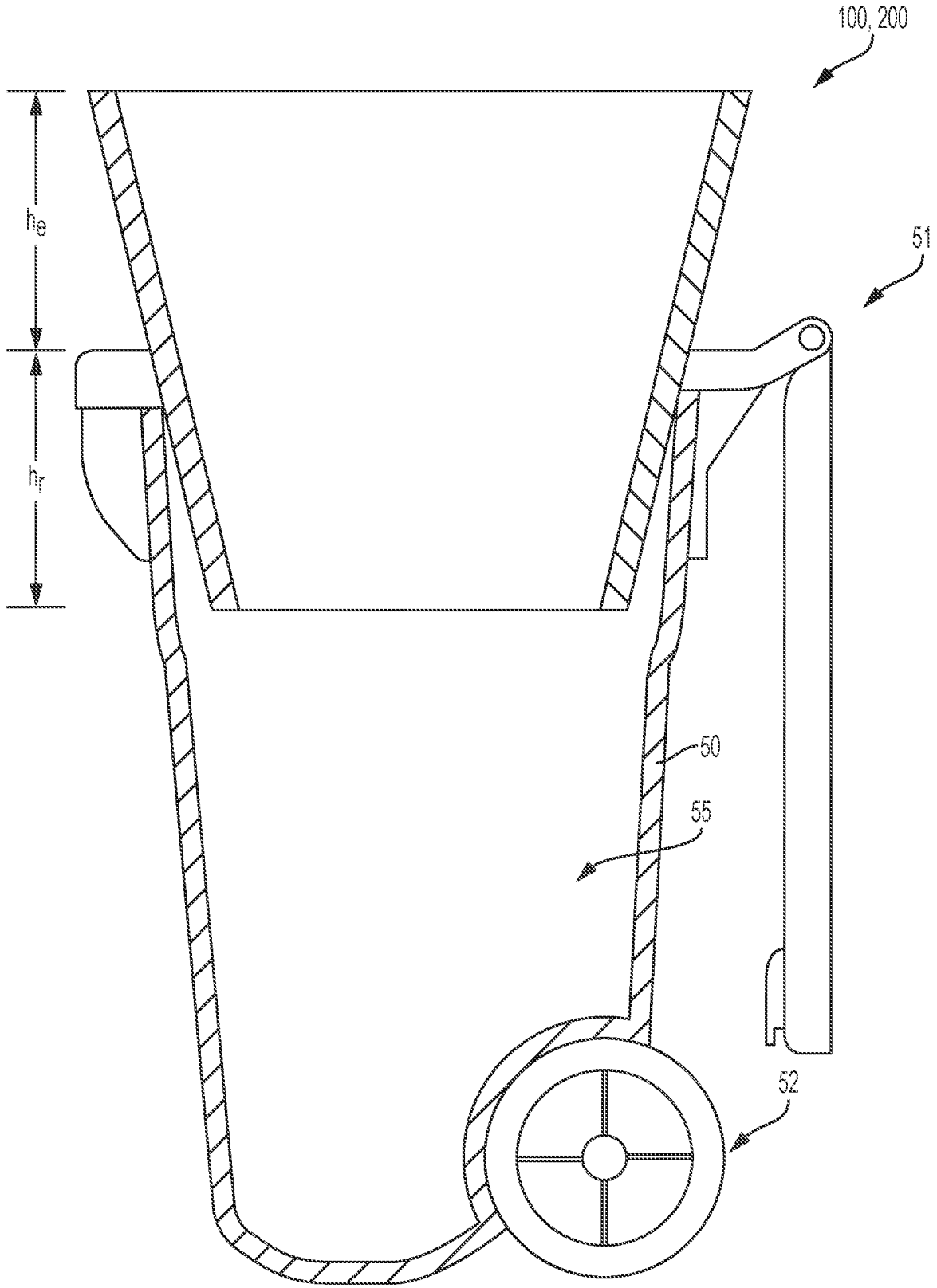
FIG. 6 depicts a sectional view of an embodiment of an extender operably configured with an embodiment of a receptacle.

Referring now to FIGS. 5 and 6, embodiments of extender 100, 200 are shown in an operable configuration and engaged with receptacle 50. The extender 100, 200 may be provided to an end user as a flat and/or folded unit, as described above, or may be provided to an end user partly folded or otherwise intact. If the extender 100, 200 comes in a folded or flat unit, a user may manipulate the plurality of walls 40*a*, 40*b*, 41*a*, 41*b* to form a box-like structure, as shown in FIGS. 5 and 6. Once assembled or otherwise formed into a box-like structure, the extender 100, 200 may be inserted within an interior 55 of the receptacle 50. Embodiments of the extender 100, 200 may be placed within the receptacle 50 from a top end 51 and driven further into the interior 55 of the receptacle 50. Because embodiments of the extender 100, 200 may be tapered, further displacement into the interior 55 of the receptacle 50 eventually results in mechanical interference between the walls 40*a*, 40*b*, 41*a*, 41*b*, or one or more deflection flaps 36, 236, and an inner surface 54 of the receptacle 50. The extender 100, 200 may be driven/pushed, forced, placed, etc. into the interior 55 of the receptacle 50 a distance, $h_r$, so as to provide a friction fit between the two components to prevent, hinder, or impede dislocation of the extender 100, 200 while the receptacle 50 is an upright, storage/collection position, as shown in FIGS. 5 and 6. In some embodiments, the extender 100, 200 may include a lip, edge, protrusion, or other surface feature that extends perpendicularly or substantially perpendicularly from an inner surface 34, 234 proximate, at, or otherwise near the second end 32, 232. The lip or engagement surface may extend perpendicularly into a center of the interior space 35, 235 so that waste materials 15 added into the extender 100, 200 may engage the lip to further hinder dislocation of the extender 100, 200 from the receptacle 50. The lip may be bent inwards by a user or may come perforated or creased for easy folding. The distance, represented by $h_r$, the extender 100, 200 enters the interior 55 of the receptacle 50 may vary and may depend on a size of the receptacle 50. In this position, the extender 100, 200 may be physically pulled out from and removed from the receptacle 50 by a user, but may be able to withstand other external forces such as wind, rain, addition of waste materials 55 to the receptacle, and the like. Furthermore, in this position, the extender 100, 200 may protrude, extend, or otherwise rise from a top end 51 of the receptacle 50 a distance, $h_e$, which may represent an increased storage capacity for waste materials 15. For instance, when waste materials 15 fill or substantially fill the interior 55 of the receptacle 50, the extender 100, 200 may be utilized to add an additional storage volume to the receptacle 50. The volume added depends on the distance, $h_e$, or height, the walls 40*a*, 40*b*, 41*a*, 41*b* extend from a top end 51 of the receptacle 50, as well as the width of each of the walls 40*a*, 40*b*, 41*a*, 41*b*. Thus, additional waste materials 15 (i.e. in addition to waste materials 15 already stored or located within the interior 15 of the receptacle 50) may be collected, stored, accommodated, received, etc. between the walls 40*a*, 40*b*, 41, 41*b* of the extender 100, 200, when the extender 100, 200 is engaged with the receptacle 50.

Figure 7:
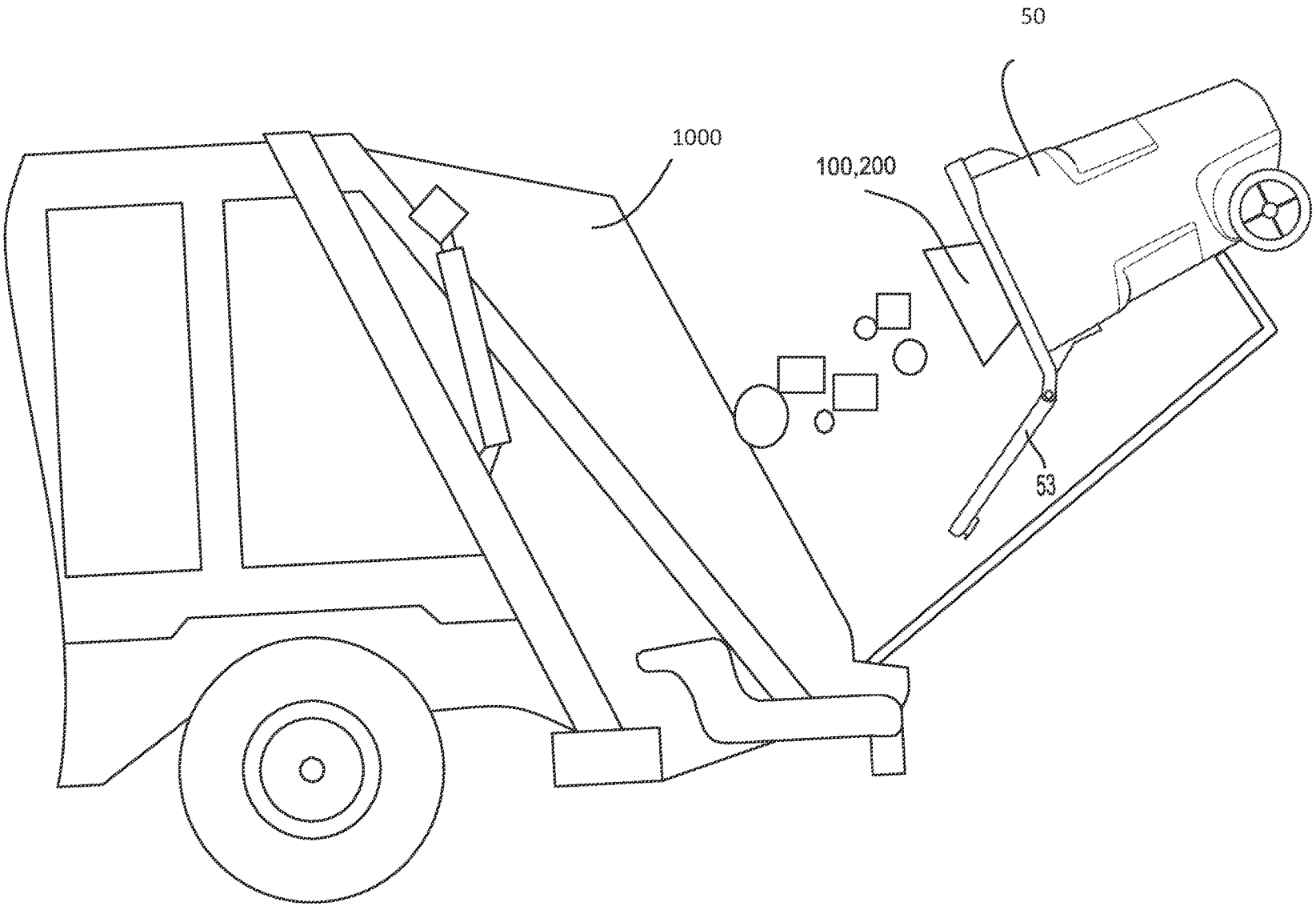
FIG. 7 depicts a schematic view of a first position of a receptacle being lifted and inverted for removal of waste contents.
Figure 8:
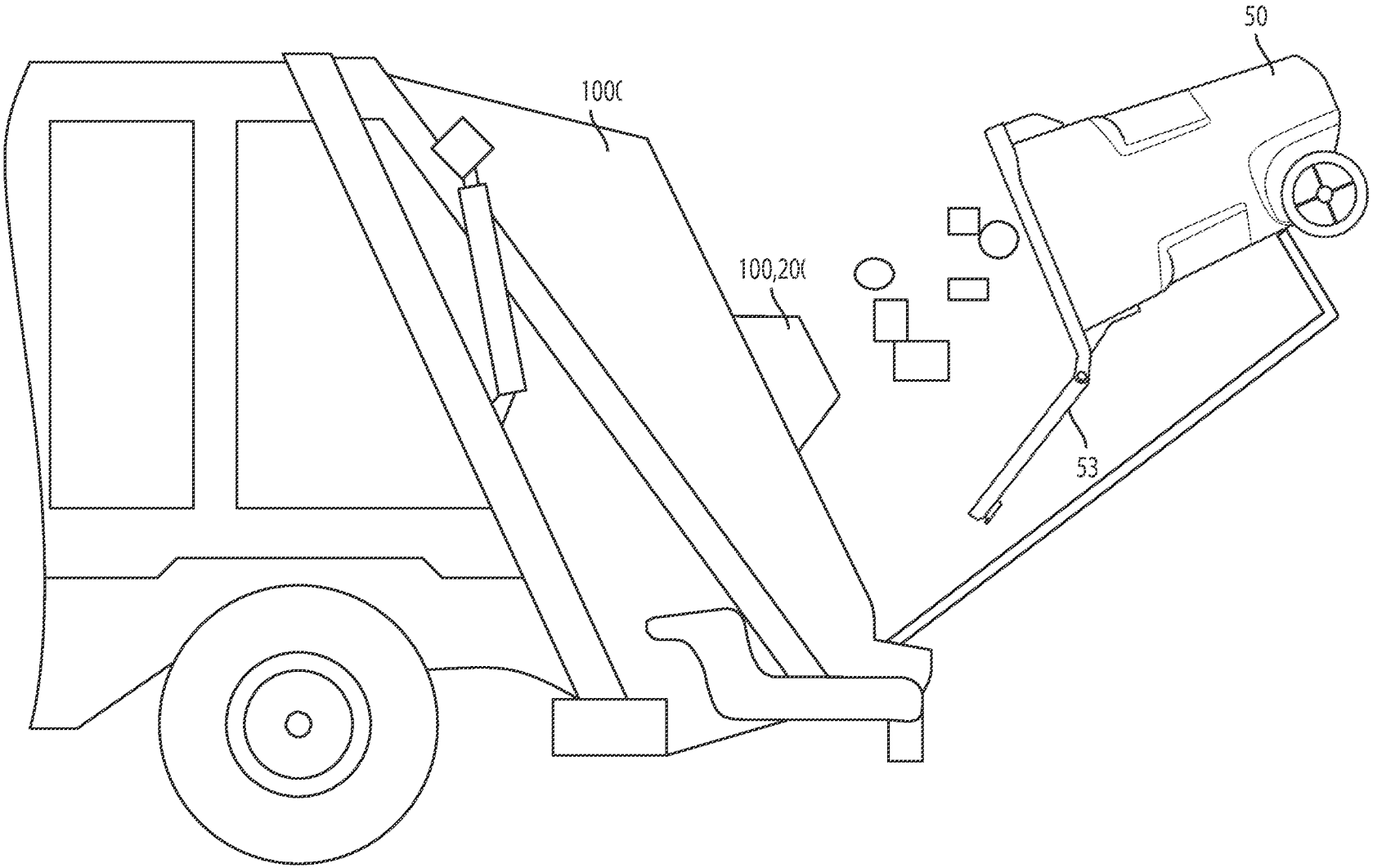
FIG. 8 depicts a schematic view of a second position of a receptacle being lifted and inverted for removal of waste contents.

With reference now to FIGS. 7 and 8, a manner in which the waste materials 15 and the extender 100, 200 may be disposed is now described. While the receptacle 50 is in an upright, collection position, with the extender 100, 200 operably engaged with the receptacle 50, waste materials 15 may be collected and stored for eventual pickup and removal by a garbage removal company or municipality service. When it comes time for the waste materials 15 to be picked up and removed, the garbage collectors may utilize a collection vehicle 1000, such as a garbage truck, to secure, grab, or otherwise manipulate the receptacle 50 to invert, at least to some degree, the receptacle 50 to allow the waste materials 15 to exit the interior 55 of the receptacle 50 and into a collection area of the collection vehicle 1000. As shown in FIG. 7, an initial amount or portion of the waste materials 15 may exit the extender 100, 200 and/or the receptacle 50 and into the collection area of the collection vehicle 1000. As the waste materials 15 continue to exit the receptacle 50, a weight of the remaining waste materials 15 passing by the extender 100, 200 may engage the extender 100, 200, for example, may engage an internal lip of the extender 100, 200 proximate the second end 32, 232, and may help drive or otherwise urge the extender 100, 200 out of physical engagement with the inner surface 55 of the receptacle 50, and into the collection area of the collection vehicle 100 along with other waste materials 15, as shown in FIG. 8. Therefore, the waste materials 15 and the extender 100, 200 are efficiently disposed of and collected in a single motion—or a single lift and invert of the receptacle 50. This may save time for the garbage collectors because they do not need to stop, bend over, and hand collect waste material stacked next to the receptacle 50 because the receptacle 50 lacked the capacity to store all of the waste. Further, no additional time may be wasted to collect the additional waste materials 15 collected/stored by the presence/use of the extender 100, 200 because the extender 100, 200 may be disposed of and collected by the garbage collection vehicle 1000 in the same motion as if just collecting the waste stored in the receptacle 50.

In alternative embodiments, a garbage collector(s) may physically lift and invert the receptacle 50 with the extender 100, 200 attached thereto and empty into a garbage collection vehicle 1000, or suitable collection means. The extender 100, 200 may likewise disengage from the receptacle 50 for disposal along with the waste materials 15.

Figure 9:
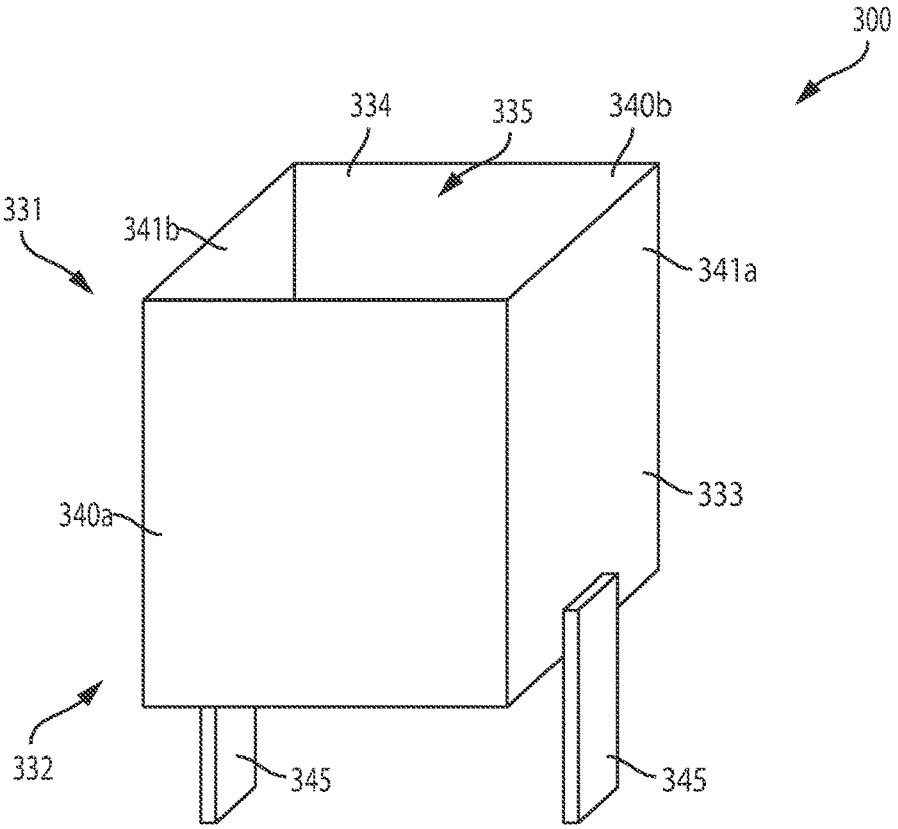
FIG. 9 depicts a perspective view of a third embodiment of an extender.
Figure 10:
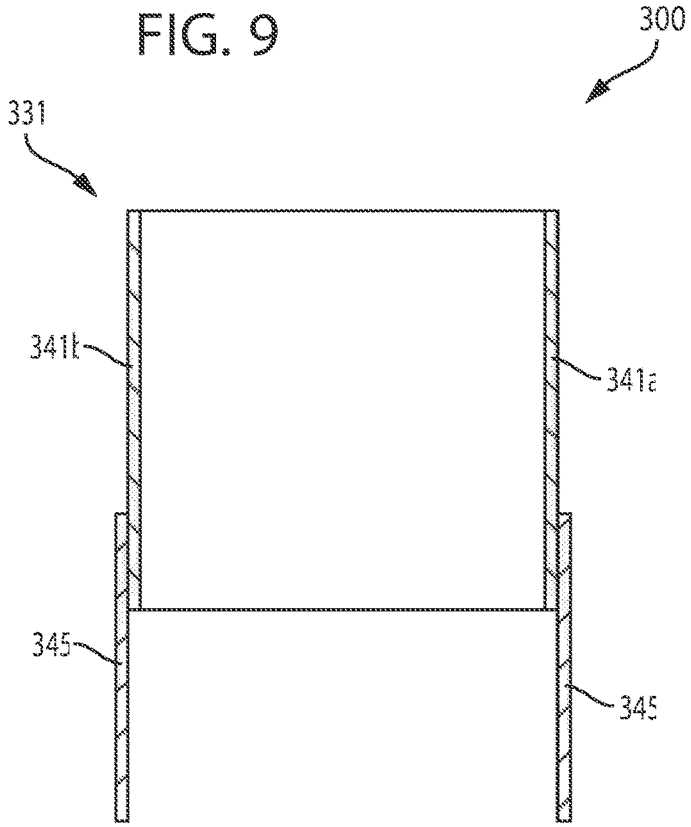
FIG. 10 depicts a sectional view of the third embodiment of an extender.

With continued reference to the drawings, FIGS. 9 and 10 depict an embodiment of extender 300. Embodiments of extender 300 may be a box, an add-on, a cardboard structure, a garbage containment unit, a cardboard accessory, or the like, sized and dimensioned to be placed on top of a cover 53 of a receptacle 50 of various sizes. The extender 300 may be a device that may be configured to be placed upon a cover 53 of a receptacle 50, such as industry standard sized garbage can, to extend or otherwise increase a capacity of the receptacle 50. The increased capacity may be an amount of volume for storing garbage, waste, yard waste, leaves, etc., or any contents suitable for placement in a receptacle that is in addition to a maximum volume afforded by the receptacle 50. For example, if the receptacle 50 becomes full of waste materials 15, such as garbage, waste, recyclables, yard waste, and the like, any additional waste materials will not fit properly within the receptacle 50, and likely fall to the side of the receptacle 50, or can blow away due to the wind or other environmental elements. To increase a volume or storage capacity of the receptacle 50, embodiments of an extender 300 may be placed on a top of a receptacle 50 so that additional waste materials 15 may be stored in addition to the waste material already stored within the receptacle 50. While the extender 300 is operatively attached to the receptacle 50, a storage capacity of the receptacle 50 is effectively increased because of the additional capacity or volume afforded by the extender 300. Embodiments of the receptacle 50 may be a garbage can, a pail, a garbage pail, a transportable waste container, a waste collection device, a barrel, a bucket, and the like. In some embodiments, the receptacle 50 may include a cover 53 that can be hingedly or otherwise pivotally attached to the receptacle 50. Further, embodiments of receptacle 50 may be various sizes, as might be offered/provided by a waste collection company or a municipality, or otherwise available for purchase at a home improvement store.

Embodiments of extender 300 may include a first end 331, a second end 332, an outer surface 333, an inner surface 334, and a general opening extending therethrough. Moreover, embodiments of the extender 300 may include a plurality of walls 340*a*, 340*b*, 341*a*, 341*b*. Each of the plurality of walls 340*a*, 340*b*, 341*a*, 341*b* may be shaped like a square or rectangle to form a box-like configuration having an interior space 335. A number and an arrangement of the plurality of walls, when operably configured, may correspond to a geometric shape of a cover 53 of the receptacle 50 so that it may efficiently rest upon a cover 53 of the receptacle 50. In one embodiment, the extender 300 may include four walls, with a front wall 340*a*, a back wall 340*b*, a first side wall 341*a*, and a second side wall 341*b*; embodiments of the extender 300 may include an optional bottom wall and/or a top wall, wherein the top wall may be opened when needed to place contents therein and closed to hinder access, provide protection against rain or other environmental elements, and/or minimize odor. For instance, a top wall may be movably or pivotally attached to the at least on the walls 340*a*, 34*b*, 341*a*, 341*b*. The walls 340*a*, 340*b*, 341*a*, 341*b* may be equal in size, or may vary in size with respect to each other. Furthermore, the walls 340*a*, 340*b*, 341*a*, 341*b* may be structurally integral with each other and joined along each edge to the next wall, as shown in FIG. 9. The edges may be creased or pre-creased to facilitate or promote flexibility of the extender 300. The flexibility of the extender 100 may vary, but in some cases, the extender 300 may be able to be folded into a flat unit, while all of the edges of the walls 340*a*, 340*b*, 341, 341*b* remain connected, structurally integral or otherwise.

Furthermore, embodiments of extender 300 may include at least one edge of one of the plurality of walls 340*a*, 340*b*, 341*a*, 341*b* may be a free edge, which may also allow the extender 300 to be packaged and sold as a flat, or relatively flat, or a folded flat unit. For example, a left edge of front wall 340*a* may be a free edge, while the other, right, edge of the front wall 340*a* is connected to the left edge of first side wall 341*a*. In this example, an edge of the second side wall 341*b* may also be a free edge. Any configuration or combination of free edges may be implemented to form extender 300. In some operable configurations, the free edges may be connected to each other for added stability once ready for use. For instance, the free edges may be connected to each other using a connection element, such as a component similar to connection element 245 described supra. In other operable configurations, the free edges may remain unconnected when placed within the receptacle 50, wherein the free edges are proximate or otherwise near each other when in this operable configuration.

Figure 11:
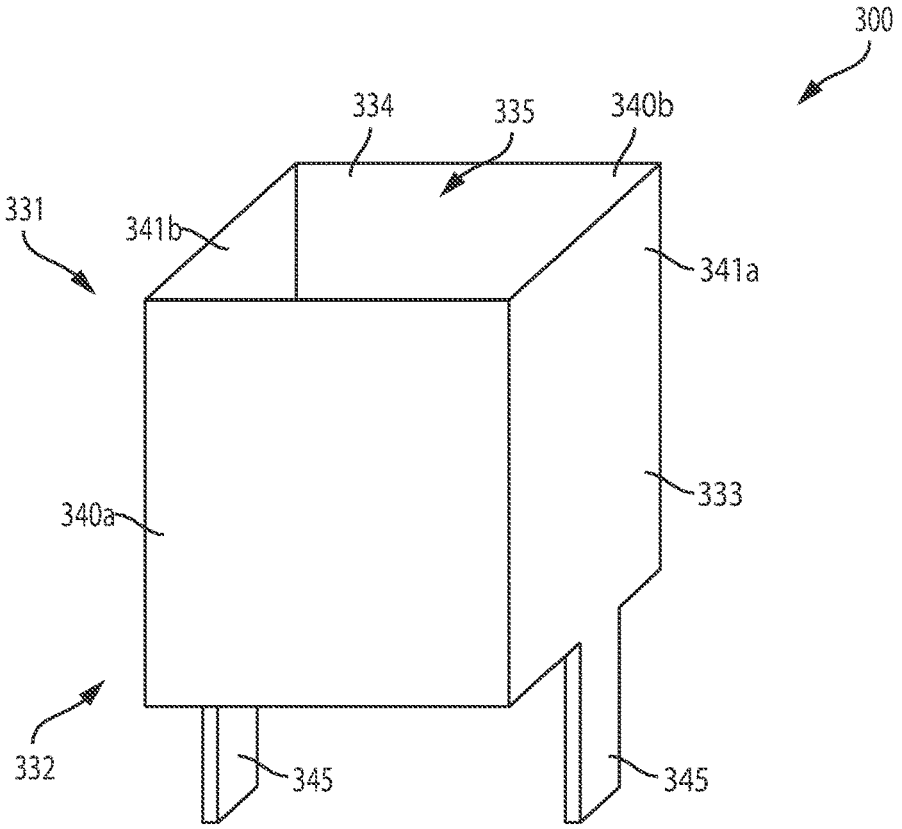
FIG. 11 depicts a perspective view of the third embodiment of an extender having at least one structurally integral wing.
Figure 12:
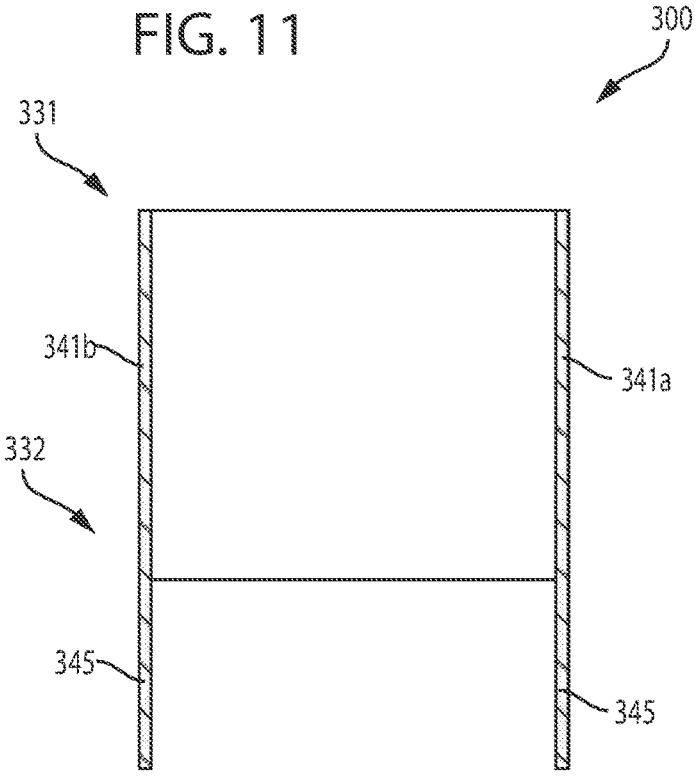
FIG. 12 depicts a sectional view of the third embodiment of an extender having one or more structurally integral wing.

Referring still to FIGS. 9 and 10, embodiments of extender 300 may include one or more wings 345. Embodiments of the one or more wings 345 may be a wing, a strap, a flap, a connector, a securing strap, a securing element, and the like. Embodiments of the one or more wings 345 may be a separate section of material that is operably attached to one or more walls, such a first side wall 341*a* and a second side wall 341*b*. For example, wings 345 may be affixed, adhered, stapled, or otherwise secured to one or more side walls of the extender 300. Alternatively, embodiments of wings 345 may be structurally integral with one or walls 340*a*, 340*b*, 341*a*, 341*b* of the extender 300, as shown in FIGS. 11 and 12. Embodiments of the one or more wings 345 may protrude, extend, or hang down beyond a second end 332 of the extender 300 a distance to allow the wings 345 to be manipulated for operable engagement with the receptacle 50. Furthermore, embodiments of the extender 300 may be made out of cardboard or other suitable material. The material(s) forming the extender 300 may be disposable. However, in some embodiments, the extender 300 may be made of a material that can be reused without significant risk of damage if exposed to environmental elements. In further embodiments, the extender 300 may be made out a metal, such as aluminum, or plastic and can be recycled with the other contents within the receptacle 50, such as known recyclable items that are commonly discarded. In even further embodiments, waste materials 15 may be segregated by type/contents by locating certain materials in the extender 300, and the more conventional or non-hazardous contents in the interior 55 of the receptacle 50. For example, normal waste materials 15 may be kept in the receptacle 50, while batteries may be placed within the interior space 335 of the extender 300 to separate the contents, making it easier for collection companies to sort contents. Sorting contents may be made easier because the contents of extender 300 may be dumped into a separate compartment of the collection vehicle 1000 (e.g. recyclables, hazardous, etc.)

Figure 13:
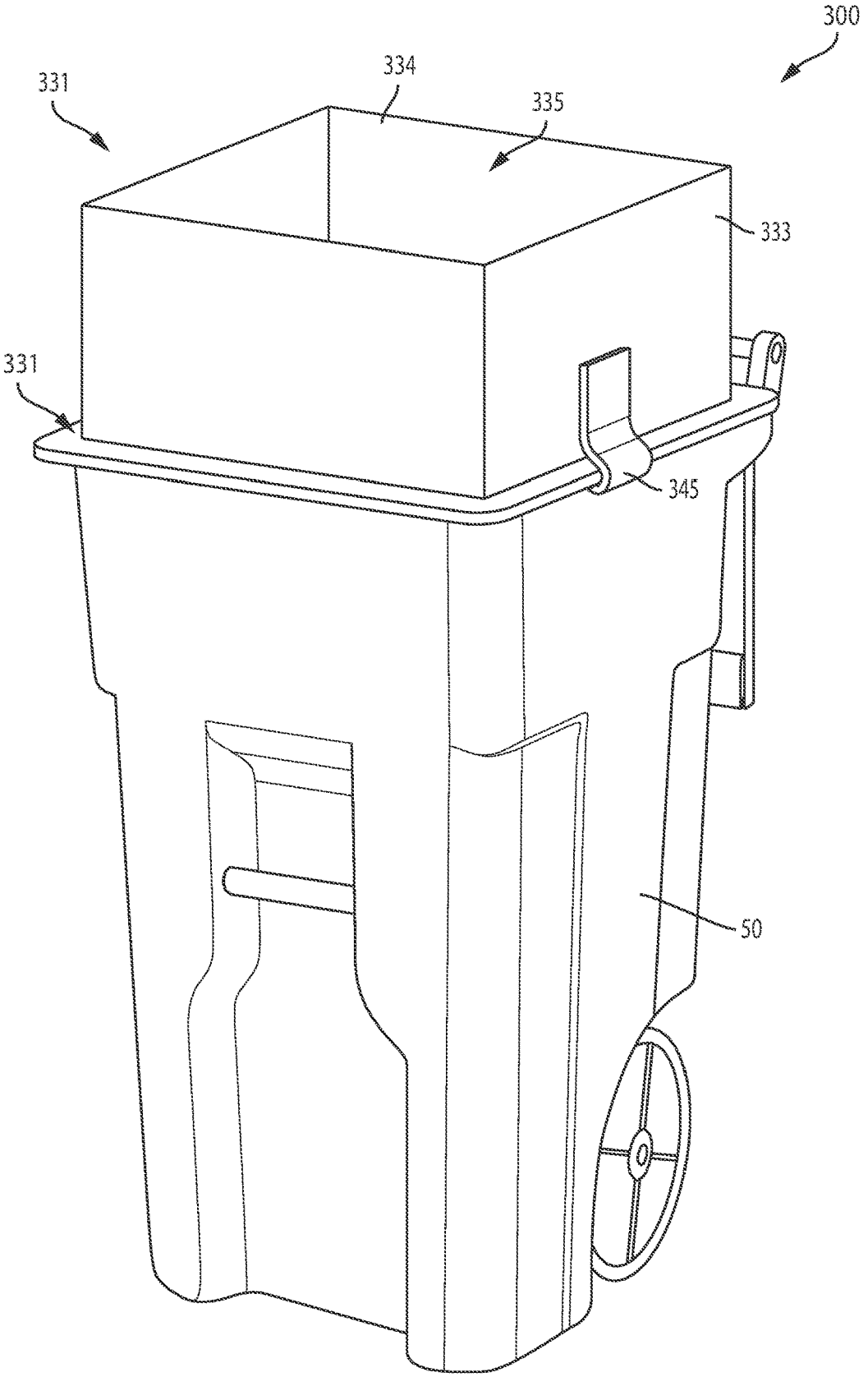
FIG. 13 depicts a perspective view of the third embodiment of the extender operably configured with an embodiment of a receptacle.
Figure 14:
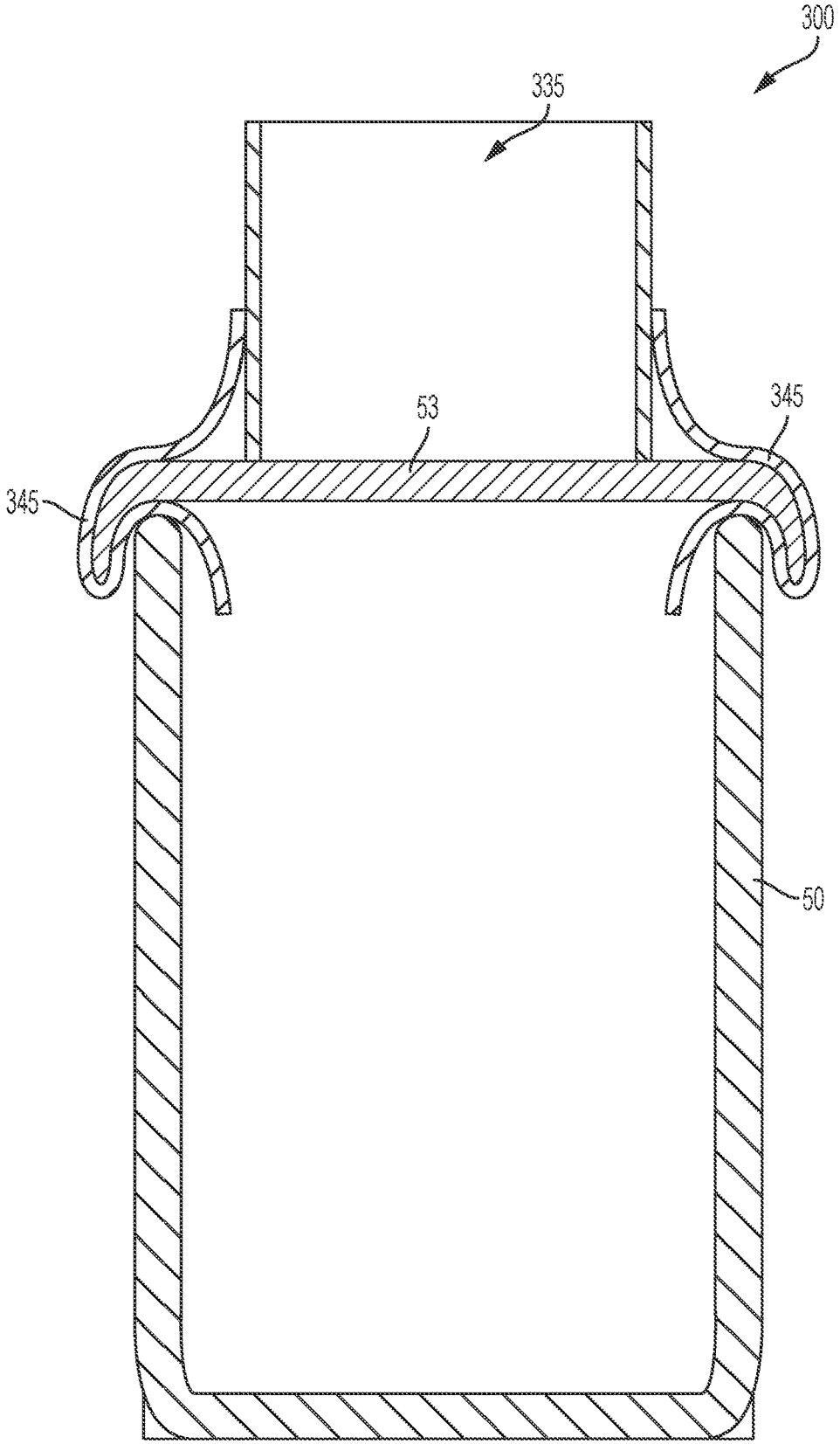
FIG. 14 depicts a sectional view of the third embodiment of the extender operably configured with an embodiment of a receptacle.

Referring now to FIGS. 13 and 14, an embodiment of extender 300 is shown in an operable configuration and engaged with receptacle 50. The extender 300 may be provided to an end user as a flat and/or folded unit, as described above, or may be provided to an end user partly folded or otherwise intact. If the extender 300 comes in a folded or flat unit, a user may manipulate the plurality of walls 340*a*, 340*b*, 341*a*, 341*b* to form a box-like structure, as shown in FIGS. 8-11. Once assembled or otherwise formed into a box-like structure, the extender 300 may be placed on a cover 53 of a receptacle 50 (e.g. when the cover 53 is closed over a top end 51 of the receptacle 50). Because the one or more wings 345 may protrude, extend, or hang down beyond a second end 332 of the extender 300 a distance, the wings 345 may be manipulated so as to be placed underneath a cover 53 of the receptacle 50 and into an interior 55 of the receptacle 50. For instance, a user may place the extender 300 on top of the receptacle 50, and at least slightly open the cover 53, and when the cover 52 is at least slightly open, the user may insert the one or more wings 345 into the interior 55 of the receptacle 50, and then return the cover 53 to a closed position. A weight of the cover 53 may secure the extender 300 in a collection position atop the receptacle 50, thus affording the receptacle 50 an increased storage capacity for waste materials 15. As more waste materials 15 are placed within the interior space 335 of the extender 300, an additional weight/force can be applied to the cover 53, thus increasing the force exerted against the one or more wings 345.

Accordingly, in this position, the extender 300 may protrude, extend, or otherwise rise from a top cover 53 of the receptacle 50 a distance, which may represent an increased storage capacity for waste materials 15. For instance, when waste materials 15 fill or substantially fill the interior 55 of the receptacle 50, the extender 300 may be utilized to add an additional storage volume to the receptacle 50. The volume added depends on the distance, or height, the walls 340*a*, 340*b*, 341*a*, 341*b* extend from a top end 51 of the receptacle 50, as well as the width of each of the walls 340*a*, 340*b*, 341*a*, 341*b*. Thus, additional waste materials 15 (i.e. in addition to waste materials 15 already stored or located within the interior 15 of the receptacle 50) may be collected, stored, accommodated, received, etc. between the walls 340*a*, 340*b*, 341, 341*b* of the extender 300, when the extender 300 is engaged with the receptacle 50.

Figure 15:
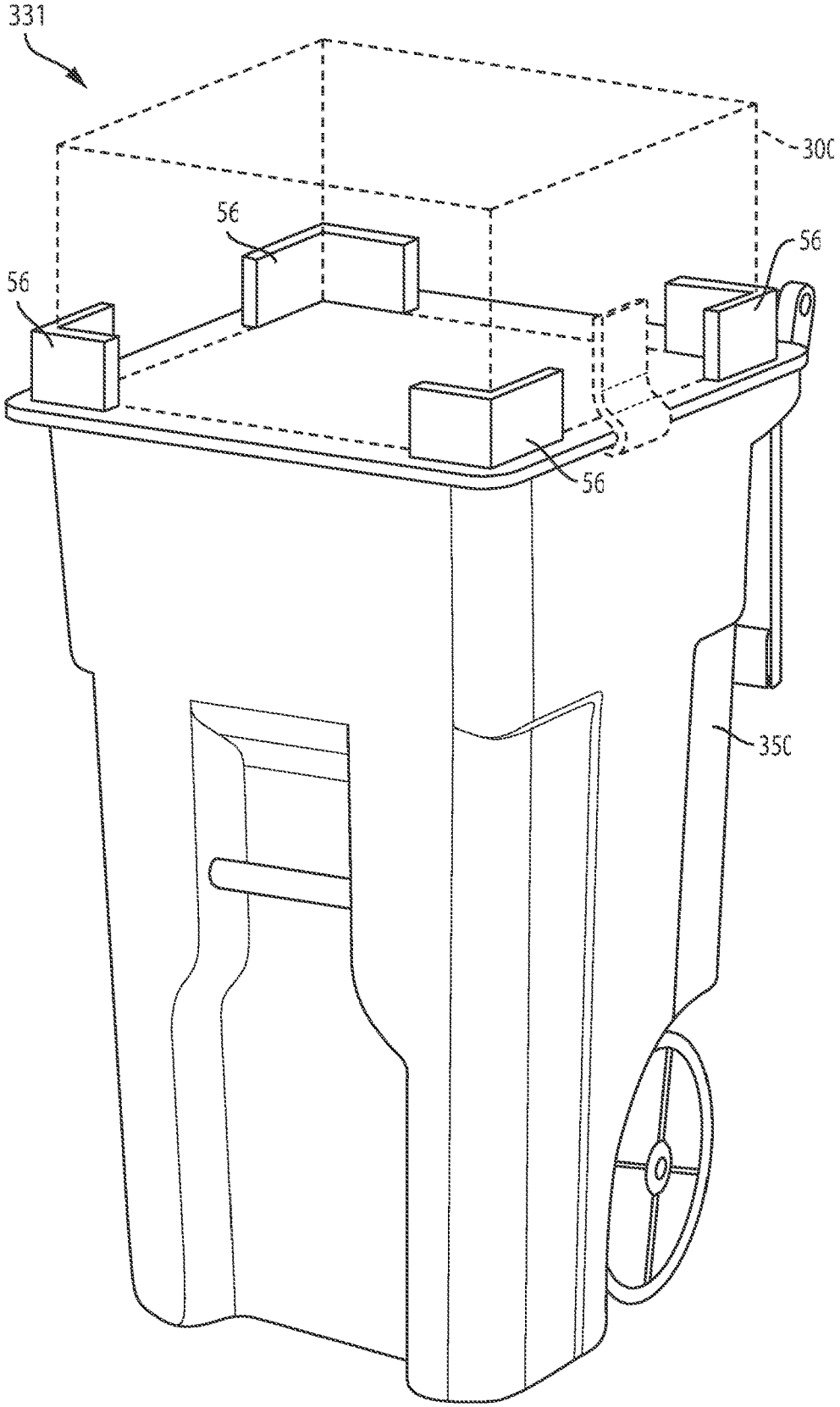
FIG. 15 depicts a perspective view of an embodiment of a receptacle having a plurality of support elements.

FIG. 15 depicts an embodiment of a receptacle 50 that may include a plurality of support elements 56. Embodiments of support elements 56 may be supports, box supports, extender supporters, framing elements, guide elements, corner elements, or any suitable component for preventing or hindering slidable movement of the extender 300 across the cover 53 of the receptacle 50 when placed atop the receptacle 50. Embodiments of the support elements 56 may be positioned in or more corner locations of the cover 53 of the receptacle 50. Additionally, support elements 56 may be positioned on the cover 53 at a location that may correspond to where a wall 340*a*, 340*b*, 341*a*, 341*b* engage the cover 53 of the receptacle 50. Embodiments of the support elements 56 may include a right angle or a substantially right angle to accommodate or correspond with a corner of the extender 300. Embodiments of the support elements 56 may include a first wall and a second wall, or a single wall, that may protrude or extend upwards from the cover 53 of the receptacle. Thus, an extender 300 may be placed between the support elements 56, wherein the support elements 56 may prevent or hinder slidable movement of the extender 300 to help retain the extender 300 in position. Further, embodiments of the support elements 56 may be structurally integral with the cover 53, or may be separately attached to the cover 53, and may be made of the same or different material of the cover 53. In most embodiments, the support elements 56 may be comprised of a rigid material.

Figure 16:
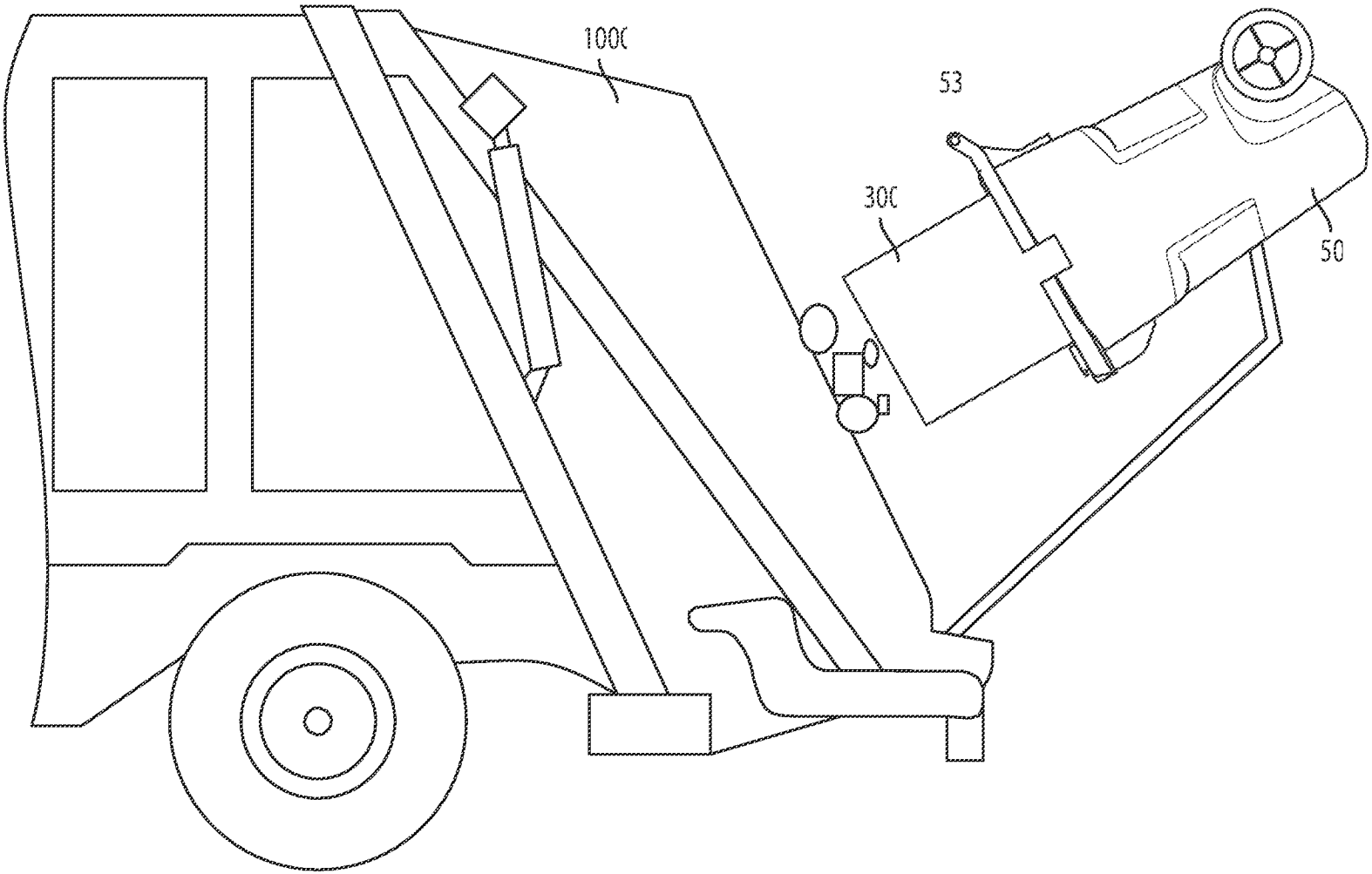
FIG. 16 depicts a schematic view of a first position of a receptacle being lifted and inverted for removal of waste contents.
Figure 17:
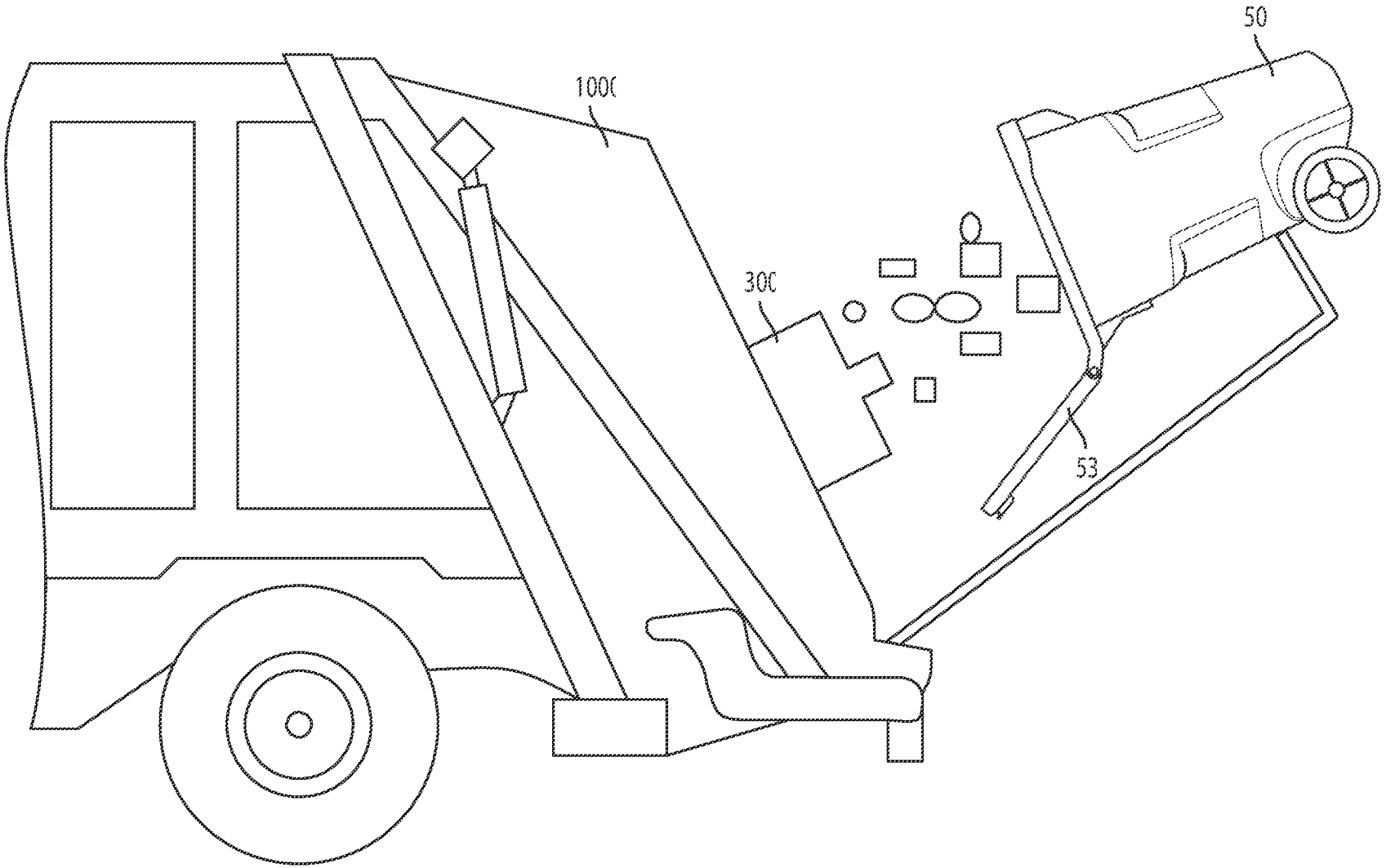
FIG. 17 depicts a schematic view of a second position of a receptacle being lifted and inverted for removal of waste contents.

With reference now to FIGS. 16 and 17, a manner in which the waste materials 15 and the extender 300 may be disposed is now described. While the receptacle 50 is in an upright, collection position, with the extender 300 operably engaged with the receptacle 50, waste materials 15 may be collected and stored for eventual pickup and removal by a garbage removal company or municipality service. When it comes time for the waste materials 15 to be picked up and removed, the garbage collectors may utilize a collection vehicle 1000, such as a garbage truck, to secure, grab, or otherwise manipulate the receptacle 50 to invert, at least to some degree, the receptacle 50 to allow the waste materials 15 to exit the interior 55 of the receptacle 50 and into a collection area of the collection vehicle 1000. As shown in FIG. 15, an initial amount or portion of the waste materials 15 may exit the extender 300 into the collection area of the collection area. As the waste materials 15 exit the extender 300 and the receptacle 50 is at least partially inverted, the cover 53 also begins to open, releasing the one or more wings 345 of extender 300. When the one or more wings 345 are released (i.e. the cover 53 no longer pinches the wings 345 against a top lip of the receptacle 50), the extender 300 is physically disengaged with the receptacle 50, and drops into the collection area of the collection vehicle 100 along with other waste materials 15, as shown in FIG. 16. Therefore, the waste materials 15 and the extender 300 are efficiently disposed of and collected in a single motion—or a single lift and invert of the receptacle 50. This may save time for the garbage collectors because they do not need to stop, bend over, and hand collect waste material stacked next to the receptacle 50 because the receptacle 50 lacked the capacity to store all of the waste. Further, no additional time may be wasted to collect the additional waste materials 15 collected/stored by the presence/use of the extender 300 because the extender 300 may be disposed of and collected by the garbage collection vehicle 1000 in the same motion as if just collecting the waste stored in the receptacle 50.

In alternative embodiments, a garbage collector(s) may physically lift and invert the receptacle 50 with the extender 300 attached thereto and empty into a garbage collection vehicle 1000, or suitable collection means. The extender 300 may likewise disengage from the receptacle 50 for disposal along with the waste materials 15.

Figure 18:
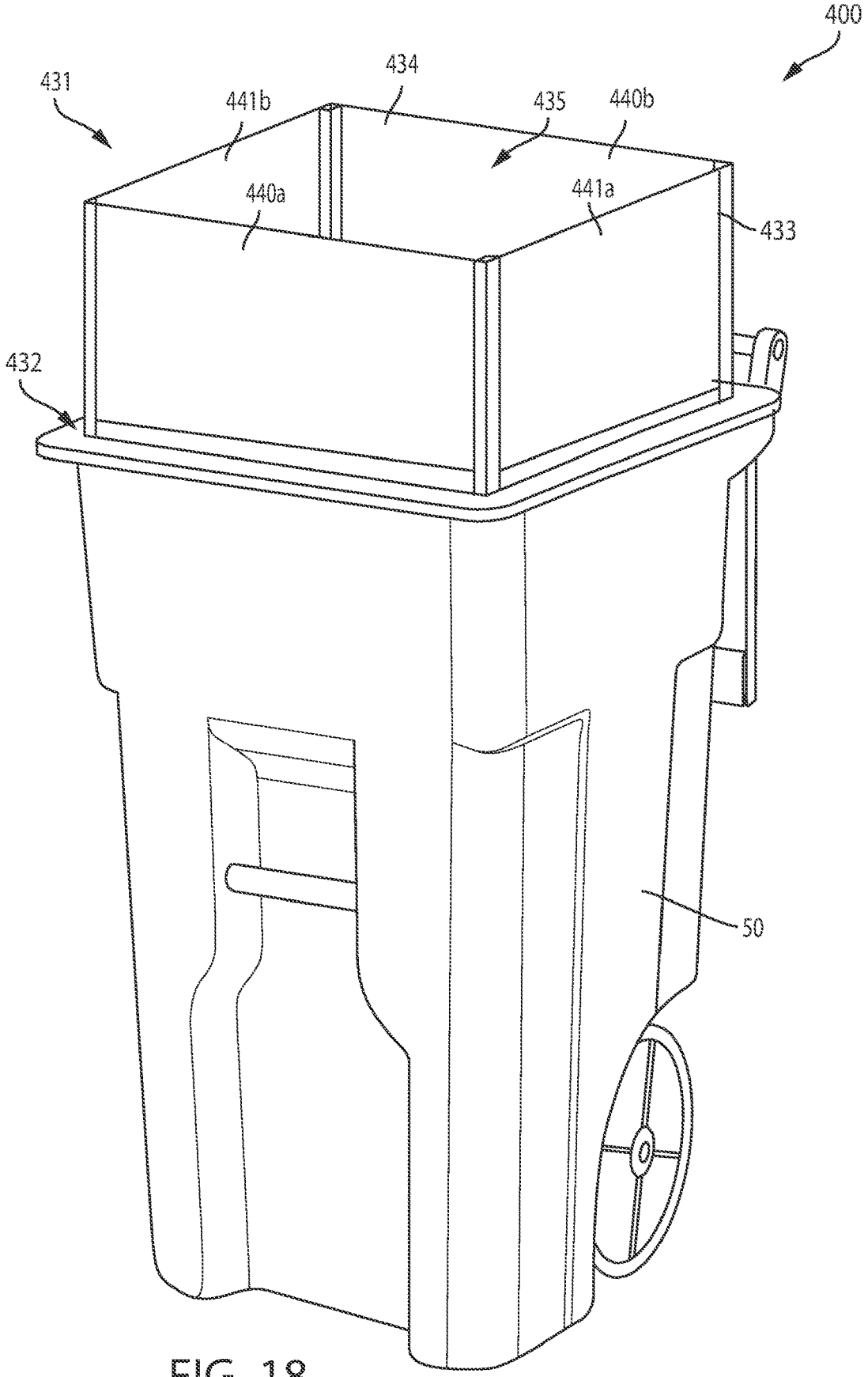
FIG. 18 depicts a perspective view of a fourth embodiment of an extender operably configured with a receptacle.
Figure 19:
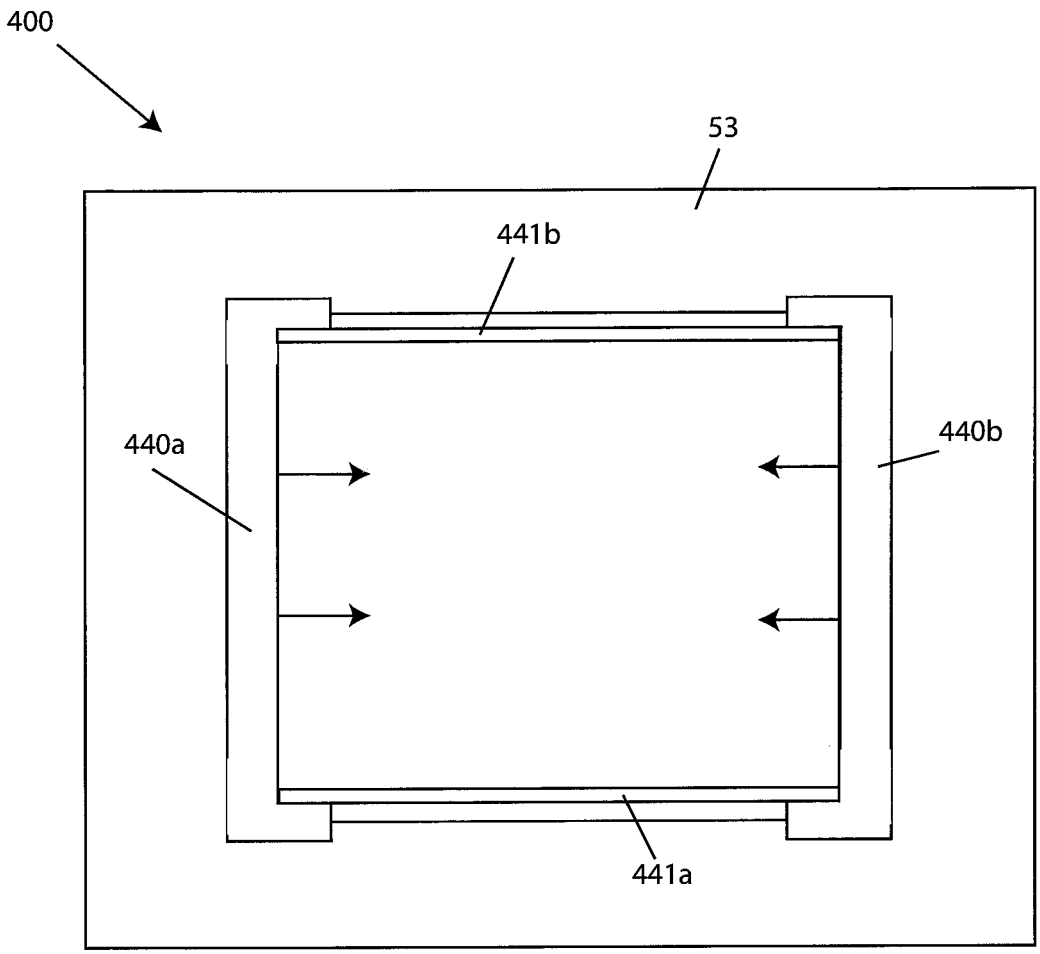
FIG. 19 depicts a top view of the fourth embodiments of an extender operably configured with a receptacle.

FIGS. 18 and 19 depict yet another embodiment of an extender 400. Embodiments of extender 400 may be permanently attached to a receptacle 50. For instance, embodiments of extender 400 may be permanently attached to a cover 53 of the receptacle 50. Embodiments of extender 400 may be collapsible, such that when additional storage capacity is not needed, the extender 400 may be collapsed into a first, flat position, and when needed to increase a storage capacity of the receptacle 50, the extender 50 may be unfolded or moved to a second, erect position. Moreover, embodiments of the extender 400 may include a plurality of walls 440*a*, 440*b*, 441*a*, 441*b*, an outer surface 433, and inner surface 434, and an interior space 435 to accommodate waste materials 15. At least two of the walls 440*a*, 440*b*, 441*a*, 441*b* may be spring loaded and hingedly movable from a flat position to an upright, erect position. While the spring loaded walls are held erect or partially erect, another wall, which may not be spring loaded, can be raised to fit between the spring loaded wall. The force of the spring loaded wall acting on either side of the free standing wall will keep the walls erect, and in the second, upright position configured to received and store waste materials 15 beyond or in addition to the waste materials 15 stored within the receptacle 50. A remaining wall, which may not be spring loaded, may also be lifted upright so as to fit between the spring loaded walls to complete the extender 400. While embodiments of extender 400 may not be disposable, the method and manner in which the contents of both the extender 400 and receptacle 50 are emptied may be similar to the methods described with respect to extender 100, 200, 300.

Referring now to FIGS. 1-19, and additional reference to FIG. 20, embodiments of a method for collecting garbage may include a step of providing a receptacle, such as receptacle 50, for storing waste materials. For example, a garbage collecting service may provide homeowners, users, renters, etc. with a receptacle 50 of a certain size, wherein the receptacle 50 may be configured to be lifted and inverted by a mechanical means of a garbage collection vehicle 1000 to empty the waste materials 15 within the receptacle 50. Another step may be to provide an extender 100, 200, 300 for use with the receptacle 50, the extender cooperating with the receptacle 50 to increase a storage capacity of the provided receptacle 50, wherein the extender 100, 200, 300 is disposable along with the waste materials 15. Another step may be collecting the waste materials 15 and the extender 100, 200, 300 at the same time, using the mechanical means of the garbage collection means 1000. For example, the extender 100, 200, 300 and the receptacle 50 may be emptied of waste materials in a same motion. This method may save labor time for the garbage collectors because a driver or operator(s) may stay in the truck and pick up the receptacle according to existing methods, yet dump the contents of the extender (and potentially the extender itself) in the same motion. Moreover, the method may allow customers to purchase a smaller trash service (e.g. smaller size container) with a temporary means in which to increase a capacity of the purchased receptacle. The disposability of the extender 100, 200, 300 may be a cost-effective alternative to buying a larger receptacle service, and may be a way for a garbage service collection company to secure more customers by including one or more extenders in a package.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. An apparatus comprising:

a garbage can, the garbage can having a lid and sized and dimensioned to be manipulated by a garbage truck, wherein the garbage can includes a substantially rigid body and a closed bottom;

a disposable extender coupled to the garbage can, the disposable extender including:

a plurality of tapered walls having a first free edge and a second free edge, each of the plurality of tapered walls being tapered from a top end of the disposable extender to a bottom end of the disposable extender, the plurality of tapered walls being joined together to define an interior space for receiving waste materials, the interior space between the plurality of tapered walls having a volume that is greater at the top end of the disposable extender than a volume at the bottom end of the disposable extender, wherein the plurality of tapered walls make up the disposable extender such that each wall of the disposable extender is a tapered wall, and the entire disposable extender tapers inwardly from the top end towards the bottom end of the disposable extender; and a connection element that joins the first free edge and the second free edge of the plurality of tapered walls together; and wherein the disposable extender, in an operable configuration, directly contacts the garbage can;

wherein the disposable extender increases a storage capacity of the garbage can when the disposable extender is inserted into an interior of the garbage can, the further the disposable extender being inserted into the garbage can the stronger the friction fit between the garbage can and the disposable extender due to the plurality of tapered walls engaging an inner surface of the garbage can, further wherein a portion of the disposable extender that enters the interior of the garbage can remains entirely within the garbage can;

wherein, when the garbage can is manipulated by the garbage truck to empty the garbage can, the friction fit between the disposable extender and the garbage can is disrupted to disengage the disposable extender from the garbage can, and is disposed into the garbage truck along with the waste materials from the garbage can.

2. The apparatus of claim 1, wherein a portion of the interior space of the extender that is located beyond a top edge of the garbage can defines an added storage capacity.

3. The apparatus of claim 1, further comprising at least one vertical slit positioned away from a corner of the plurality of tapered walls.

4. The apparatus of claim 1, wherein the extender is disposed along with the waste materials located in the garbage can.

5. The apparatus of claim 1, wherein the extender is recyclable.

6. A method of collecting garbage, comprising:

utilizing the apparatus as claimed in claim 1.

7. An apparatus comprising:

a garbage can, the garbage can having a lid and sized and dimensioned to be manipulated by a garbage truck, wherein the garbage can includes a substantially rigid body and a closed bottom;

a disposable extender coupled to the garbage can, the disposable extender including:

a plurality of walls having a first free edge and a second free edge, each wall of the plurality of walls including a tapered section extending along an edge of the wall between a top end of the disposable extender and a bottom end of the disposable extender, the plurality of walls defining an interior space for receiving waste materials, the interior space between the plurality of tapered walls having a volume that is greater at the top end of the disposable extender than a volume at the bottom end of the disposable extender, wherein the plurality of walls make up the disposable extender, and the entire tapered section tapers inwardly towards the bottom end of the disposable extender; and a connection element that joins the first free edge and the second free edge of the plurality of tapered walls together; and wherein the disposable extender, in an operable configuration, directly contacts the garbage can;

wherein the disposable extender increases a storage capacity of the garbage can when the disposable extender is inserted into an interior of the garbage can, the further the disposable extender being inserted into the garbage can the stronger the friction fit between the garbage can and the disposable extender due to the plurality of walls engaging an inner surface of the garbage can, further wherein a portion of the disposable extender that enters the interior of the garbage can remains entirely within the garbage can;

wherein, when the garbage can is manipulated by the garbage truck to empty the garbage can, the friction fit between the disposable extender and the garbage can is disrupted to disengage the disposable extender from the garbage can, and is disposed into the garbage truck along with the waste materials from the garbage can.

8. The apparatus of claim 7, wherein the extender is disposed along with the waste materials located in the garbage can.

9. A method for collecting garbage, comprising:

utilizing the apparatus as claimed in claim 7.

10. A method for collecting garbage, comprising:

providing a garbage can for storing waste materials, the garbage can being sized and dimensioned to be lifted and inverted by a mechanical means of a garbage collection vehicle to empty the waste materials, wherein the garbage can has a lid, a substantially rigid body, and a closed bottom;

providing an extender for use with the garbage can, the extender coupled to the garbage can to increase a storage capacity of the provided garbage can, wherein the extender is disposable along with the waste materials, the extender having a plurality of tapered walls having a first free edge and a second free edge, each of the plurality of tapered walls being tapered from a top end of the disposable extender to a bottom end of the disposable extender, the plurality of tapered walls being joined together to define an interior space for receiving waste materials, the interior space between the plurality of tapered walls having a volume that is greater at the top end of the disposable extender than a volume at the bottom end of the disposable extender, wherein the plurality of tapered walls make up the disposable extender such that each wall of the disposable extender is a tapered wall, and the entire disposable extender tapers inwardly from the top end towards the bottom end of the disposable extender, and the extender having a connection element that joins the first free edge and the second free edge of the plurality of tapered walls together;

wherein the disposable extender, in an operable configuration, directly contacts the garbage can;

at the same time, collecting the waste materials and the extender using the mechanical means of the garbage collection means.

11. The method of claim 10, wherein the extender and the garbage can are emptied of waste materials in a same motion.

12. The method of claim 10, wherein waste materials located within an interior space of the extender is emptied without an operator touching the extender.

13. The method of claim 10, further comprising: providing a replacement extender when the extender is disposed of along with the waste materials.

14. The method of claim 10, further comprising: forming one or more guide elements on the lid of the garbage can.

* * * * *